United States Patent [19]

Griffiths et al.

[11] 3,960,362

[45] June 1, 1976

[54] HOIST CONTROL WITH LIMIT SWITCHES

[75] Inventors: Thomas C. Griffiths, Forrest City; Albert L. Slack, Little Rock, both of Ark.

[73] Assignee: Eaton Corporation, Cleveland, Ohio

[22] Filed: Oct. 8, 1974

[21] Appl. No.: 513,013

[52] U.S. Cl. ..... 254/168
[51] Int. Cl.[2] ..... B66D 1/00
[58] Field of Search ..... 254/168, 173; 91/461

[56] References Cited

UNITED STATES PATENTS

| | | | |
|---|---|---|---|
| 850,694 | 4/1907 | Valentine | 254/168 |
| 1,787,328 | 12/1930 | Schöttler | 91/461 |
| 3,053,344 | 9/1962 | Buck | 254/173 |
| 3,365,175 | 1/1968 | Pompiliu et al. | 254/173 |

*Primary Examiner*—M. H. Wood, Jr.
*Assistant Examiner*—Michael J. Forman
*Attorney, Agent, or Firm*—Teagno & Toddy

[57] ABSTRACT

A hoist control system having a limit switch assembly is utilized in a pendant controlled pneumatic hoist to limit hoist travel to a predetermined range within preset upper and lower limits. The hoist travel limits and the range are controlled by a pair of limit switches which are actuated by a pair of actuating members which move in response to rotation of the hoist motor. The initial positions of these movable members are independently preset by initially setting them on a threaded shaft which is mounted proximately to the limit switches. The shaft rotates in response to hoist motor rotation causing the constrained movable members to move linearly along the threaded rotating shaft until they actuate one of the limit switches. The actuated limit switch controls a valve assembly to prevent supply air from driving the hoist motor to thereby stop further hoist movement.

7 Claims, 6 Drawing Figures

HOIST CONTROL WITH LIMIT SWITCHES

BACKGROUND OF THE INVENTION

1. Field of the Invention

The present invention relates to hoist control systems generally and more particularly to a hoist control system having limit switches to maintain hoist travel within predetermined limits.

2. Description of the Prior Art

Hoists are known which limit their chain or rope travel to a predetermined range by the use of various limiting devices. Such devices include trip switches for shutting off hoist power. These switches are actuated by trip members located on the chain or rope of the hoist. As the hoist travels to a predetermined raising or lowering position the trip member at the appropriate end of the chain or rope will actuate the trip switch mounted proximately to the chain or rope guide member. The trip switch will then shut off power to the hoist motor to thereby stop the hoist.

Large capacity pneumatic hoists utilize plunger actuated, normally open, valve members mounted in the vicinity of the chain guide as trip switches and enlarged beads on opposite ends of the chain or rope as the trip members. When the enlarged bead on the chain or rope depresses the valve plunger, the normally open valve closes. Since this valve is connected in line with the hoist motor, power to the motor is effectively blocked thereby and the hoist is stopped.

Small capacity pneumatic hoists usually do not provide limit switches. Instead they rely on a brake clutch arrangement whereby the clutch slips upon a predetermined load being applied to the hoist. Thus whenever either end of the chain or wire rope interfere with the chain guide the clutch slips and further hoist movement is prevented. However, the motor is not shut off and provisions have to be made for dissipating any heat generated in the brake clutch.

The above described systems for limiting the range of hoist travel are beset with specific problem areas. Since the trip members are located on the chain or wire rope of the hoist, these members are always exposed to the work area external of the hoist where the trip members can be moved or damaged by the load being lifted or by other objects located in the work area. The trip switches also can be damaged by impact with the lifted load. Where a brake clutch arrangement is used, some added structure is required to dissipate the heat generated in the brake clutch. This added structure adds to the cost and longevity of the hoist.

These problems and others are solved by the present invention which provides an inexpensive system of limiting hoist travel to predetermined limits which system is safely enclosed within the hoist assembly and which provides an accurate and easily adjustable range of hoist travel.

SUMMARY OF THE INVENTION

In accordance with one aspect of the present invention, a hoist control system is provided which maintains hoist travel within predetermined limits through a uniquely connected and mounted limit switch assembly. The limit switch assembly is mounted proximately to the hoist motor and is responsive thereto to deactivate the hoist motor upon a predetermined rotation of the hoist motor. This is accomplished by mounting a threaded rotating shaft proximately to the hoist motor to allow motor rotation to rotate the shaft. A pair of threaded nut members are constrained on the shaft to linearly move on the shaft in response to its rotation. A pair of actuators are mounted proximate to the opposite ends of the shaft and are actuated by the nut members whenever they move along the shaft to the position of the actuators. The actuators upon actuation by the nut members prevent rotation of the hoist motor to stop the hoist.

Clearly the present limit switch system is located away from any areas wherein there is danger of having the system jammed, repositioned, or broken by the hoist load or other objects external of the hoist since the present system is mounted proximately to the hoist motor and may be enclosed along with the hoist motor. Also the desired range of hoist travel may be more easily and accurately set by simply positioning the nut members to a desired starting position on the threaded shaft.

In specific application to a pneumatic hoist, the limit switch assembly is coupled with a control valve which supplies air to an air motor driving the hoist. The control valve is a piston controlled valve which connects supply air to the air motor of the hoist until the control valve is actuated by the limit switch assembly. Upon such actuation the control valve exhausts the supply air to atmosphere to effectively short circuit the air motor supply.

It will thus be seen that one aspect of the present invention is to provide a hoist control system having a limit switch assembly mounted proximately to the hoist motor and being operable therefrom.

Another aspect of the present invention is to provide a hoist limit switch assembly which is actuated upon a predetermined hoist rotation to cut off power to the hoist motor.

Yet another aspect of the present invention is to provide a control valve for a pneumatic hoist which is actuated by the limit switch assembly to exhaust supply air normally supplied to the hoist motor upon a predetermined rotation of the hoist motor.

These and other objects will be more clearly understood upon consideration of the following description of the preferred embodiment and the drawings.

DESCRIPTION OF THE PREFERRED EMBODIMENT

Figure 1:
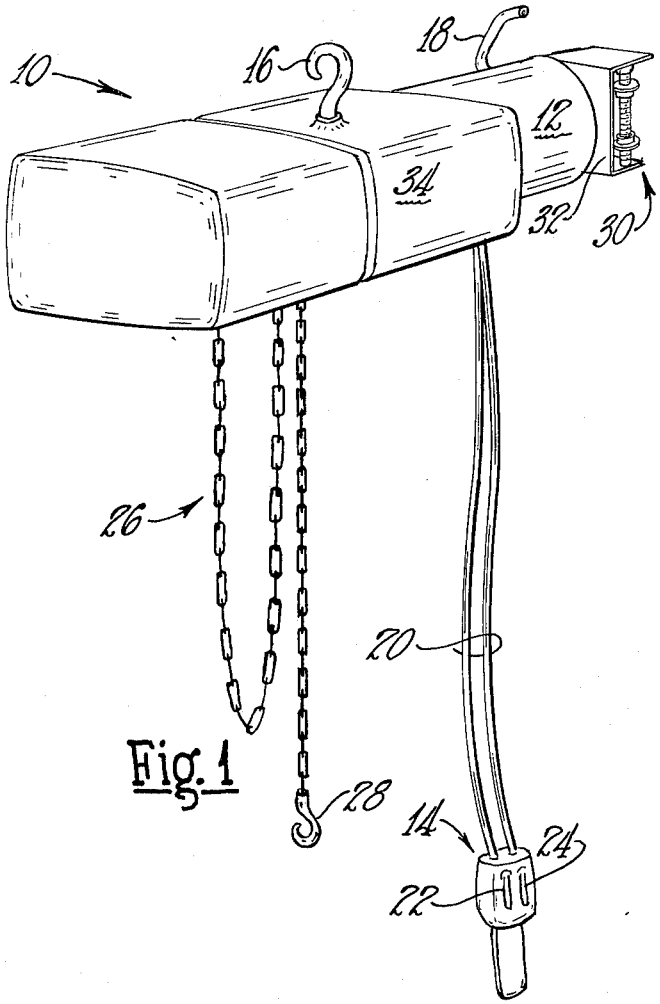
FIG. 1 is a perspective drawing of a pendant controlled pneumatic hoist with a cut-away section in the area of the limit switch assembly.

Referring now to the drawings wherein the showings are of a preferred embodiment of the present invention it will be understood that the previously described invention is not limited to the depicted embodiment but could just as easily be used in conjunction with electric powered hoists as well as other machinery requiring a controlled range of movement.

As may be best seen with reference to FIG. 1 the preferred embodiment of the invention is in a pneumatic hoist 10 which is driven by an air motor 12 and controlled by a hoist operator through a pendant control 14. The hoist 10 is suspended from a support surface by a hook 16 and is powered by supply air through a supply line 18. Air is transmitted from the hoist 10 to the pendant 14 by connecting lines 20 which selectively power the motor 12 to rotate in a predetermined direction depending upon the operator's actuation of either levers 22 or 24 which are located on the pendant 14. The motor 12 is connected to a chain or wire rope assembly 26 through a gear train (not shown) to provide the desired lifting force and speed to the chain or rope 26. The chain 26 carries a load on a hook 28 and either raises or lowers the load in response to selective rotation of the motor 12. The heretofore described structure and its operation is well known to those skilled in the art and will not be described in further detail for the sake of conciseness and readability.

A unique limit switch assembly 30 is mounted proximate to the hoist motor 12 wherein it is easily enclosed by housing 32 which may be an extension of the motor 12 housing or even an extension of a hoist housing 34 when the motor is enclosed therein. This location of the limit switch assembly 30 insures that the assembly will be protected from the usually dirty and crowded work area of the hoist 10 from which the assembly 30 could be easily fouled or broken. The limit switch assembly 30 is mounted proximately to the hoist motor 12 which actuates the assembly 30 and which is in turn controlled by the same assembly 30. This allows a centralization of the required control elements resulting in a less expensive and easily assembled total assembly.

Figure 2:
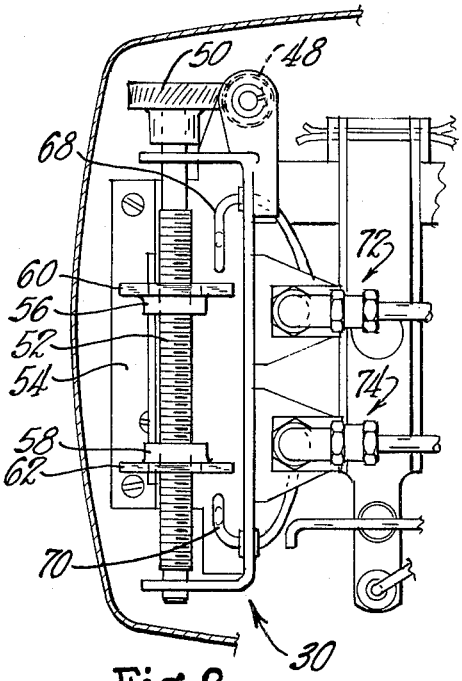
FIG. 2 is an expanded end view of the limit switch assembly of FIG. 1.
Figure 3:
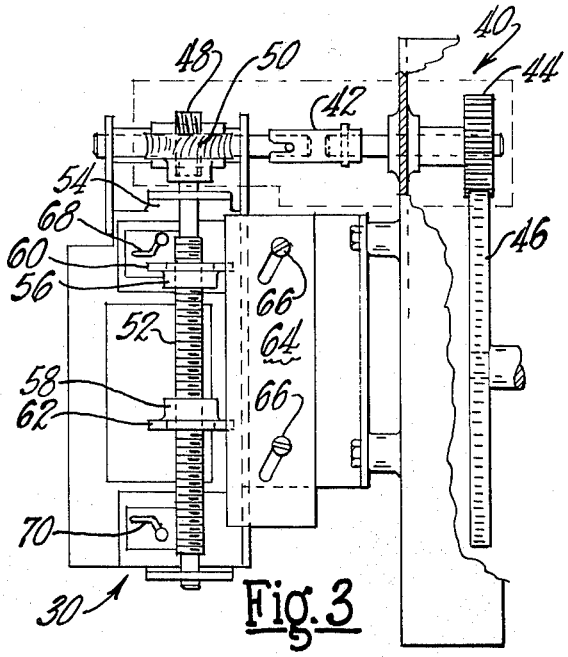
FIG. 3 is a side view of the limit switch assembly of FIG. 2.
Figure 3A:
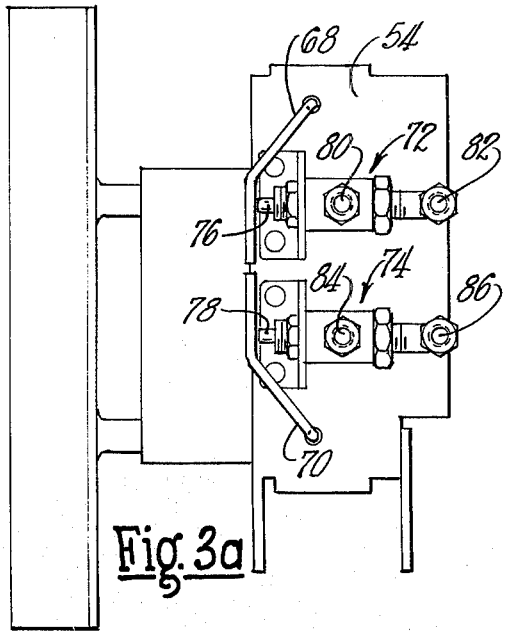
FIG. 3a is an opposite side view of the assembly of FIG. 3 showing the actuators of the limit switch assembly.

Referring now to FIGS. 2, 3, and 3*a* with particular reference to FIG. 3 it will be seen that the limit switch assembly 30 is connected to be responsive to the motor 12 through a connecting assembly 40 connected to the main drive shaft of the hoist to insure constant relative positioning of the limit switch assembly 30 and the position of the chain or rope assembly 26. This connecting assembly 40 includes a coupling shaft 42 having a drive pinion gear 44 mounted thereto. The pinion gear 44 is driven by a drive gear 46 which responds to motor 12 rotation. The other end of the coupling shaft 42 has mounted thereon a worm gear 48 which drives a worm gear 50 to rotate a threaded shaft limit switch assembly 52 rotatably supported on a support structure 54. Clearly the shaft 52 will rotate in response to hoist motor 12 rotation in either a clockwise or a counterclockwise direction depending upon the rotational direction of the motor 12.

Threaded on the shaft 52 are a pair of actuating members 56 and 58 in the form of internally threaded nuts having threaded portions compatible to the threads of the threaded shaft 52. Each member 56 and 58 has an extended face 60 and 62 which is hexagonal but which may also be sprocketed and which interferes with a removable retainer plate 64 which is affixed to the support structure 54 by screws 66. The slots holding the screws 66 are angled to insure that the plate 64 always returns to the actuator member 56 and 58 interfering position even if the screws 66 are not tightened. The support plate 64 prevents the actuating members

56 and 58 from rotating with the threaded shaft 52 and thereby constrains them to move linearly along the shaft 52 in response to rotation of the shaft 52. The direction of shaft 52 rotation will determine the direction of linear movement of the members 56 and 58 along the shaft 52. A pair of limit actuators 68 and 70 are pivotally mounted through the support member 54 proximately to the ends of the shaft 52. The placement of the actuators 68 and 70 is such that they would be respectively pivoted or tripped by either the actuating members 56 or 58 when they move a predetermined distance along the shaft 52. The tripped actuators 68 and 70 thereby provide an indication of upper and lower limits of hoist chain 26 travel. The amount of such travel is determined by the initial positioning of the members 56 and 58 on the shaft 52. To provide this initial positioning the retainer plate 64 must be removed. With the retainer plate 64 removed, the members 56 and 58 may be independently threaded to move up or down on the shaft 52 to set the respective upper and lower hoist chain 26 travel limits. The difference in travel between these set limits then represents the range of hoist chain 26 travel. The accuracy of these set points and consequently the range of chain 26 travel is determined by the number of threads per linear length of shaft 52. The set points and range may be set by first moving the hoist 10 to the desired limits and threading the respective member 56 or 58 along the shaft 52 until the respective actuator 68 or 70 is tripped. The retainer plate 64 is then replaced to prevent the members 56 and 58 from stationarily rotating with the shaft 52.

The switch assembly 30 is now coordinated to hoist chain 26 travel and will repeatedly trip the respective actuators 68 and 70 at the respective preset limits of chain 26 travel to maintain hoist travel within the preset range.

To insure that the hoist will stop operating at these upper and lower hoist limits the actuators 68 and 70 control the operation of the hoist 10 air supply to prevent supply air from reaching the hoist motor 12. As may be best seen with reference to FIG. 3a, the limit actuators 68 and 70 accomplish this by controlling their respective normally open 3-way valves 72 and 74. As the actuating member 56 is driven along the shaft 52 it will eventually pivot the limit actuator 68 causing it to depress an actuating pin 76 which prevents flow between an inlet port 80 and an outlet port 82 of the valve 72. Similarly when actuating member 58 depresses an actuating pin 78 flow through the 3-way valve 74 is prevented between an inlet 84 and an outlet 86. The interruption of normal flow through either valve 72 or 74 prevents supply air from reaching the hoist motor 12 thereby preventing the hoist 10 from being further controllable by the pendant 14.

Figure 4:
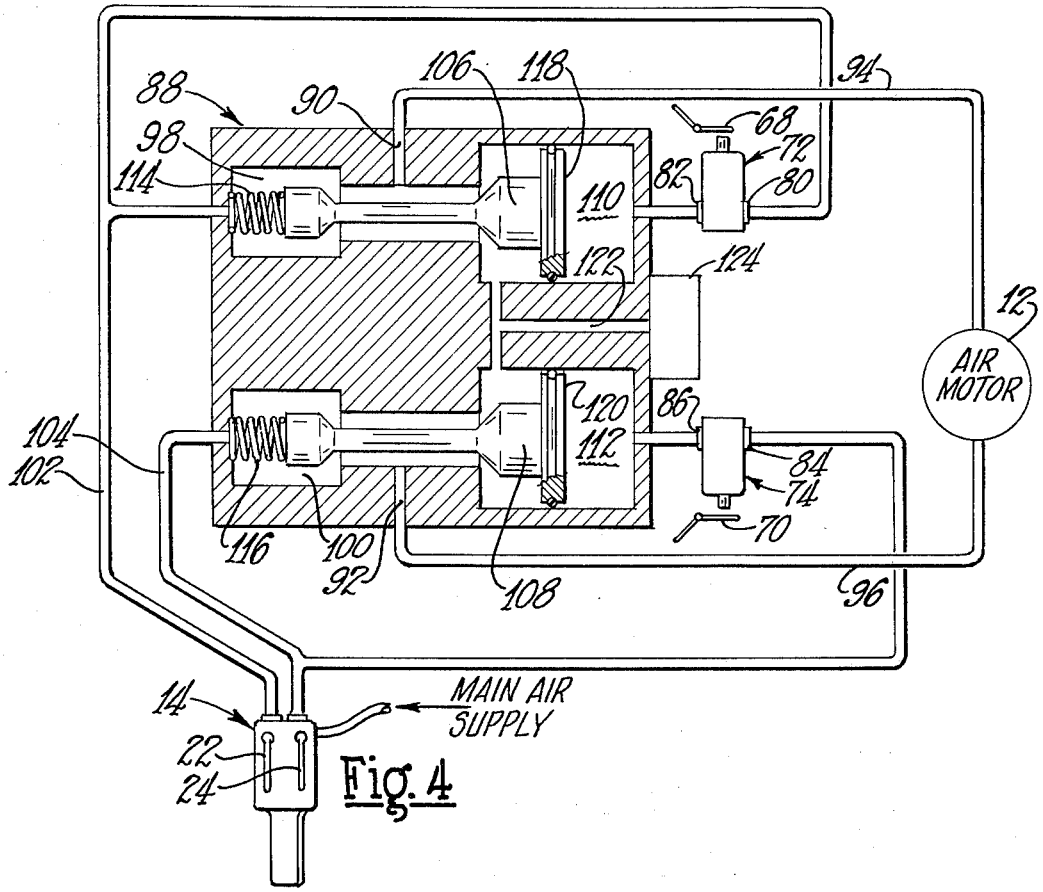
FIG. 4 is a schematic drawing of a main air supplied pendant controlled valve for providing supply air to the hoist motor.

The aforedescribed limit control system is adaptable to hoists having either pilot air or main supply air controlling pendants. As may be best seen with reference to FIG. 4, a hoist assembly is shown wherein the pendant 14 controls the supply of main supply air to the hoist motor 12 through a control valve 88 which is mounted proximately to the hoist motor 12. Opposite sides of the motor 12 are connected to the valve 88 by connecting lines 94 and 96 which are respectively connected to separate outlets 90 and 92. Supply air is selectively transmitted by the pendant 14 to separate inlet chambers 98 and 100 of the control valve 88 along connecting lines 102 and 104 by the selective depression of the levers 22 and 24. The chambers 98 and 100 are in respective communication with the valve outlets 90 and 92 so long as the normally open 3-way valves 72 and 74 remain unactuated by the limit switch assembly 30. The motor 12 may thus be driven in either rotational direction by the application of supply air to one or the other side of the motor 12. The valves 72 and 74 bias one side of respective pistons 106 and 108 against springs 114 and 116 by pressurizing chambers 110 and 112 with pilot air derived from lines 102 and 104, respectively. The pressure of the pilot air works against a larger surface area 118 and 120 of the respective pistons 106 and 108 to produce a larger force than that produced by the pressure of the supply air working against the smaller area on the opposite end of the pistons 106 and 108 along with the force of the restoring springs 114 and 116.

Thus to operate the hoist in a load lifting direction the operator depresses lever 22 causing supply air to flow from the pendant 14 to the inlet chamber 98 and the pilot chamber 110 through connecting lines 102 and 80. The supply air then is communicated therefrom to the air motor 12 by outlet 90 and connecting line 94 causing the motor 12 to rotate in a clockwise direction and raise the load thereby. The shaft 52 rotates in response to motor 12 rotation causing the actuating member 56 to move laterally along the shaft 52 until the limit actuator 68 is pivoted to close the normally open 3-way valve 72. Valve 72 being a 3-way valve quickly depressurizes the chamber 110 and the piston 106 is driven to the right by the force of the spring 114 and the supply air to block the outlet 90 from communication with the inlet chamber 98. This prevents further supply air from reaching the hoist motor 12 and the hoist will no longer respond to actuation of the lever 22.

The hoist may be driven, however, in the load lowering direction from either this maximum load raising position or any other position by depressing the lever 24 to supply the other side of the hoist motor 12 with supply air through connecting line 96. The hoist motor 12 will be thus driven in a counterclockwise direction with the actuating member 58 moving laterally along the shaft 52 until the limit actuator 70 is pivoted to close the normally open three-way valve 74. The piston 108 will now similarly move to the right under the force of the spring 116 and the supply pressure to block further flow of supply air to the motor 12. The hoist is now unresponsive to further actuation of the lever 24 having reached its lower limit. Again, however, the hoist may be moved in the load raising direction by depressing the lever 22.

It will be noted that the control valve 88 has a large vent port 122 which communicates with the air motor 12 by way of outlets 90 and 92 and lines 94 and 96 when either of the pistons 106 and 108 are in the furthermost righthand positions. This insures that when the hoist reaches either its upper or lower limits the motor 12 will be quickly vented to the atmosphere through a muffler 124 to quickly stop any further motor 12 rotation.

From the foregoing it will be seen that the present limit control system when used with a control valve 88 and a main supply air providing pendant 14 will allow the hoist 10 to operate only in a range of chain travel between an upper and a lower limit. Upon reaching either of these limits the hoist motor 12 is shut off and will not respond to the control of the pendant 14 indicating further movement of the hoist in the same direction.

Figure 5:
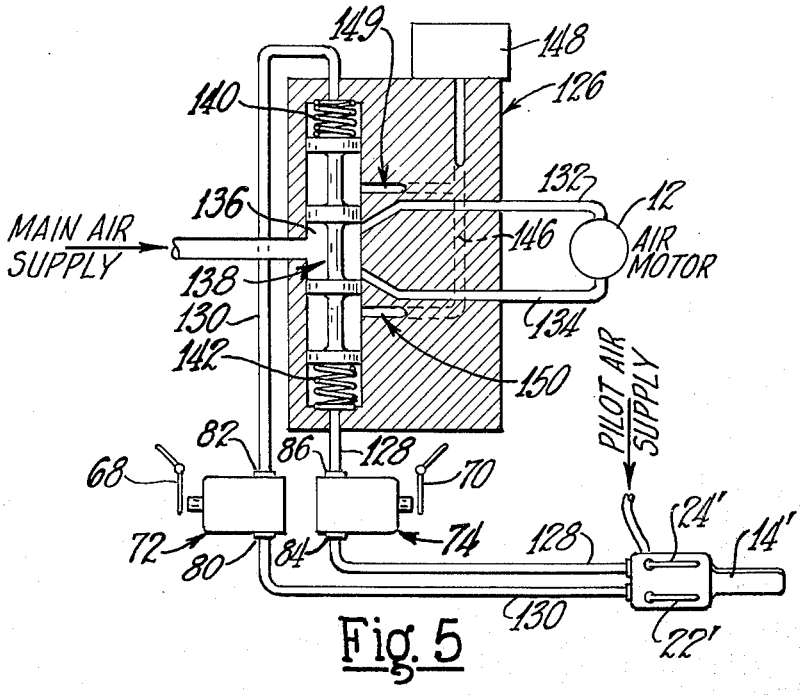
FIG. 5 is a schematic drawing of a pilot air supplied pendant control for providing supply air to the hoist motor.

Referring now to FIG. 5 it will be seen that the present limit control system can also be used with a pilot air operated pendant 14' and a pilot air controlled control valve 126. The normally open three-way valves 72 and 74 are connected in line with connecting lines 128 and 130 which transmit the application of pilot air from the pendant 14' to the control valve 126. The control valve 126 is mounted proximately to the hoist motor 12 and normally provides main supply air to both sides of the motor 12 along lines 132 and 134 from a chamber 136 connected to the main air supply. The motor 12 is, therefore, pressure balanced and will not rotate in either direction until this balanced condition is upset. The control valve 126 has a spool member 138 located within a cavity therein and balanced between a pair of springs 140 and 142. When hoist movement is desired in the load raising direction the operator depresses lever 22' which permits the flow of pilot air to one side of the spool member 138 along line 130 and increases the pressure thereto. The spool member 138 becomes unbalanced and moves to a position connecting the line 132 to a vent line 149 and supplying main supply air to only line 134. One side of the motor 12 is now variably exhausted through a muffler 148 to atmosphere and the air supplied side causes the motor 12 to rotate and the chain 26 to move in a load lifting direction. This direction is maintained until the limit actuator 72 is triggered to shut off and then exhaust pilot air flow to the previously pressurized side of the spool member 138 and leave the member 138 balanced by the springs 140 and 142. The springs will return the spool member 138 to its initial position of supplying supply air to both sides of the motor 12 along lines 132 and 134 and preventing further motor rotation.

The hoist will be similarly driven in the load lowering direction by depressing lever 24' until the actuator 70 shuts off the normally open valve 74. Thus an upper and lower limit is provided for hoist chain travel in hoist control systems utilizing pilot air supplying pendants and pressure balanced air motors.

Certain modifications and improvements will occur to those skilled in the art after reading this specification. Expansion of all such improvements and modifications will not be discussed in detail herein for the sake of conciseness and readability but it will be understood that the disclosure is encompassing thereof.

We now claim:

1. A limit switch actuated control valve assembly for supplying power to the air motor of an air motor driven hoist comprising:

a housing forming a main chamber communicating with an exhaust port for venting the main chamber, a supply inlet port for providing supply air to the main chamber, and an outlet port for supplying supply air from the main chamber to the air motor;

piston means slidably mounted within the main chamber to seal the exhaust port and connect the supply inlet port to the outlet port in a first position and to seal the air supply port and connect the outlet port to the exhaust port in a second position;

a biasing pressure chamber formed in said housing on one side of said piston means limit switch means for moving said piston means between said first and second positions in response to a control signal, said limit switch means including a normally open valve connected to the biasing pressure chamber to supply air to the pressure chamber and maintain said piston means in said first position until said control signal is provided; and means for providing a control signal to said limit switch means upon the hoist reaching a predetermined hoisting position.

2. Apparatus as claimed in claim 1, including a first control valve assembly for supplying power to said air motor in a hoist raising direction and a second control valve assembly for supplying power to said air motor in a hoist lowering direction, a common exhaust conduit connecting the exhaust ports of said first and second control valve assemblies, and a muffler connected to the outlet end of said common exhaust conduit.

3. Apparatus as claimed in claim 1, including first valve seat means formed in said main chamber, second valve seat means formed in said biasing pressure chamber, a first valve element formed on said piston means cooperating with said first valve seat means to control air flow between said inlet port and said outlet port, and a second valve element formed on said piston means cooperating with said second valve seat means to control air flow between said outlet port and said exhaust port.

4. Apparatus as claimed in claim 3, in which said piston means comprises an elongated cylindrical member having said first valve element formed adjacent one end thereof and said second valve element formed adjacent a second end thereof, said valve elements being coaxially formed on said cylindrical member and spaced apart thereon relative to said first and second valve seat means so that said first valve element closes against said first valve seat element when said second valve element is in an open condition relative to said second valve seat element and vice versa.

5. Apparatus as claimed in claim 4, including a biasing spring acting on said first end of said cylindrical element to bias said first valve element toward its closed condition, and an enlarged diameter piston element formed at the extreme second end of said cylindrical member adjacent said second valve element and in sealing engagement with a wall of said biasing pressure chamber, the area of said piston element relative to said first valve element and said biasing spring being sufficiently large to insure that said cylindrical member is biased to a position biasing said first valve element to its open condition when equal pressures are applied to said main chamber and said biasing pressure chamber.

6. A hoist control system having limit switches to maintain hoist travel within predetermined limits comprising:

an air motor for driving the hoist in either a load raising or a load lowering direction in response to rotation thereof;

a control valve connected between an air supply and said air motor for selectively activating said air motor in either the load raising or lowering direction;

pendant means for providing said air supply to said control valve in response to actuation thereof by a hoist operator;

limit switch means for deactivating said control valve in response to a predetermined movement of the hoist in either the load raising or lowering direction;

connecting means for coupling said hoist motor to said limit switch means including a threaded shaft rotatably mounted proximately to said hoist motor and being responsive thereto to rotate in response to rotation of said hoist motor;

said limit switch means including a first traveling nut threaded on one end of said shaft, a second traveling nut threaded on the opposite end of said shaft, a first actuator mounted proximate one end of said shaft to be triggerable by said first nut, a second actuator mounted proximate the opposite end of said shaft to be triggerable by said second nut, retaining means for preventing rotation of said first and second nut with rotation of said shaft while allowing said first and second nuts to laterally move along said shaft in response to rotation of said shaft, and signal generating means including a normally open valve connected between said pendant means and said control valve, said normally open valve being closed by one of said actuators when moved to a predetermined spot on said shaft by the rotation thereof to shut off said air supply to said control valve.

7. A hoist control system as set forth in claim 6 wherein said control valve has formed therein a vent port, and wherein said signal generating means includes a pair of normally open valves connected to said control valve, said pair of valves normally providing a first signal for blocking the vent port of said control valve and providing said air supply to said motor, said pair of valves providing a second signal for blocking said air supply from said motor and opening said vent port whenever one of said valves is closed by one of said actuators.

* * * * *